United States Patent [19]

Gelineau et al.

[11] Patent Number: 4,599,808

[45] Date of Patent: Jul. 15, 1986

[54] DRYING METHOD AND APPARATUS FOR FIBROUS MATERIAL

[75] Inventors: Frederick D. Gelineau, San Jose, Calif.; Thomas B. Kinney, Foxboro, Mass.

[73] Assignee: The Foxboro Company, Foxboro, Mass.

[21] Appl. No.: 714,005

[22] Filed: Mar. 20, 1984

[51] Int. Cl.[4] ..... F26B 21/10

[52] U.S. Cl. ..... 34/27; 34/48; 34/46; 34/50

[58] Field of Search ..... 34/13.8, 46, 48, 191, 34/16.5, 50, 27, 26, 32

[56] References Cited

U.S. PATENT DOCUMENTS

| | | | |
|---|---|---|---|
| 3,337,967 | 8/1967 | Smith | 34/46 |
| 4,209,915 | 7/1980 | Keuleman et al. | 34/55 |
| 4,229,507 | 10/1980 | Kai et al. | 34/13.8 |
| 4,356,641 | 11/1982 | Rosenau | 34/46 |

FOREIGN PATENT DOCUMENTS 1470163 4/1977 United Kingdom .

*Primary Examiner*—Larry I. Schwartz

[57] ABSTRACT

Drying material such as lumber by controlling the difference between inlet drying air dry bulb temperature and outlet drying air dry bulb temperature while maintaining wet bulb temperature constant, so that drying is characterized by a constant rate of evaporation.

9 Claims, 1 Drawing Figure

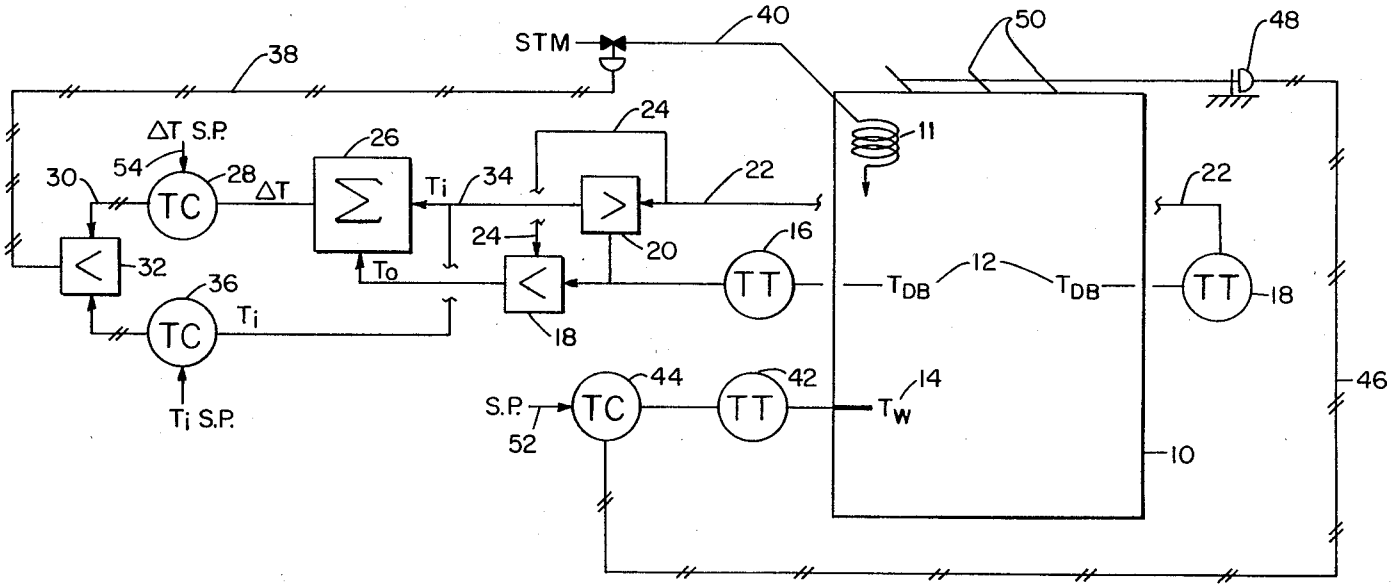
46
48
22
18
TT
10
50
$T_{DB}$
12
$T_{DB}$
11
14
$T_W$
40
22
16
TT
42
TT
24
20
44
TC
STM
18
S.P.
52
34
24
$T_i$
26
$T_o$
38
$\Delta T$
28
$T_i$
36
$\Delta T$ S.P.
TC
TC
$T_i$ S.P.
54
32
30

DRYING METHOD AND APPARATUS FOR FIBROUS MATERIAL

FIELD OF THE INVENTION

This invention relates to drying, and in particular to the drying of lumber.

BACKGROUND OF THE INVENTION

It is known to dry lumber by stacking it on railed trucks for movement through a kiln into which ambient air is drawn by fans, in the kiln, which drive the air past steam-heated pipes and then past the stacked planks (horizontally layered on transverse "stickers" of wood about an inch thick, which let the air pass between plank layers) and then out of the kiln.

In drying conducted as just described, it has been known to control the dry bulb temperature of inlet heated air at a predetermined figure.

SUMMARY OF THE INVENTION

We have discovered that drying may be accomplished more rapidly and efficiently, particularly in avoiding in drying lumber what is known in the art as "casehardening", if, during at least an earlier time stage of drying, control is by maintaining a predetermined dry bulb temperature drop across the heated air, while at the same time maintaining the wet bulb temperature of inlet heated air at a predetermined amount, so that in effect what is controlled is rate of evaporation of water. (It may be noted that F. G. Shinsky taught in "Energy Conservation Through Control", Academic Press 1978, pp. 218–219, that in an adiabatic system in which wet bulb temperature is maintained constant, rate of evaporation is directly proportional to the difference in dry bulb temperatures across the thing being dried.)

In a preferred embodiment, in a later time stage of drying control is switched from as described in the preceding paragraph to control of inlet heated air dry bulb at a predetermined figure.

PREFERRED EMBODIMENT

We turn now to a description of the drawing, and of the structure and operation of a preferred embodiment of the invention.

Drawing

The drawing is a schematic view of said embodiment.

STRUCTURE

There is shown diagrammatically in the drawing compartment kiln 10, constructed in general accordance with the prior art as above discussed. The kiln may be say 18 feet high and 90 feet long, enough to accommodate at the same time six trucks of lumber. As was known, say ten fixed-pitch fans may be mounted in the kiln above the top of the locus of truck movement, spaced along the length of the kiln and rotatable in either one direction to drive air directly toward one longitudinal (in a length direction) wall or upon reversal to the other direction of rotation to drive air toward the opposite longitudinal wall. Two steam pipe units extend generally horizontally in the top of the kiln, one over one-half of the kiln's length, and the other over the other, again as was known. (Only one of these units 11 is indicated, and very diagrammatically, in the drawing.) Also as was known, two longitudinal rows of vents provided in the top of the kiln allow for inlet of ambient air and exhaust of air that has passed over the lumber.

We locate four dry bulb temperature sensors 12 at about six feet above the floor of the kiln, two on one transverse side of the truck track and two on the other, each of the pair on one side being about a quarter of the length of the kiln in from one or the other of an end of the kiln. (Only one of each such pair is shown in the drawing, in which the kiln is diagrammatically shown in end view.) Two wet bulb temperature sensors 14 are mounted one half-way between each longitudinal pair of dry bulb temperature sensors. (Only one of the pair is, of course, shown in the drawing.)

Turning again to the drawing, there is shown responsive to one dry bulb temperature sensor 12 temperature transmitter 16, which transmits to signal selector 18 and 20. The two dry bulb temperature sensors 12 shown are a pair on opposed transverse sides of the kiln. Responsive to the other dry bulb temperature sensor 12 is temperature transmitter 18, which transmits through lines 22 and 24 respectively to signal selectors 20 and 18. The output from signal selectors 18 and 20 go into summer 26.

The output of summer 26 goes into temperature controller 28, which provides through line 30 an output to signal selector 32. Line 34 provides an input to temperature controller 36, which provides another input to signal selector 32, which in turn provides an output through line 38 to an IDP converter to vary the steam introduced through line 40 to unit 11.

Cooperating with the two dry bulb temperature sensors that are not shown is another complete arrangement, also not separately shown, as discussed in the two preceding paragraphs.

One wet bulb temperature sensor 14 is connected with temperature transmitter 42, which signals temperature controller 44, which through line 46 and actuator 48 opens, or closes, to some extent the vents 50 over the two coil units.

OPERATION

The desired wet bulb temperature is set into the set point 52 of temperature controller 42, which thereupon opens or closes a set of vents 50 to maintain the predetermined wet bulb temperature, in a preferred embodiment, 125° F. (The two wet bulb temperature sensors 14 have their output fed through an averaging system to refine the result, although actually one of these two sensors could be omitted—either one.)

In said preferred embodiment, the predetermined difference between inlet dry bulb temperature $T_i$ and outlet dry bulb temperature $T_0$ (i e., $\Delta T$) is 10° F., and is set into set point 54 of controller 28; this means, of course, that $T_0$ is in said embodiment 150° F., $T_i$ being 160° F. During the initial period this difference is what is controlled and maintained, and doing so controls to a constant rate of drying, and thus greatly relieves from case-hardening, in which too-rapid evaporation of surface moisture relative to deeply inner moisture allows capillaries in the wood to shrink, to make more difficult getting out the last undesirable amounts of water.

However, we have found that a time comes, as evaporation penetrates more into the wood, when it is desirable to switch over to control not of $\Delta T$ but of inlet dry bulb temperature. Otherwise, the wood would if to be highly dried be overheated, in an attempt to maintain $\Delta T$ despite the reduced cooling effect owing to reduced evaporation. The embodiment disclosed provides for this.

Thus, selector 18 selects and passes on to summer 26 the lower of the dry bulb temperatures (i.e., $T_0$) of one transverse pair, while selector 20 selects and passes on to the summer the higher of the dry bulb temperatures (i.e., $T_i$) thereof. Selection thus is necessary because of the reversal of fan rotation direction every three hours, making following each reversal what had been the $T_i$ and $T_0$ sensors become respectively the $T_0$ and $T_i$ sensors. (In one direction of rotation, the fans drive the air against one longitudinal wall, then down it and through the lumber and across the floor of the kiln, then up the other longitudinal wall and out the vents.)

Summer 26 applies $\Delta T$ to controller 28. When the lumber is dry enough that $\Delta T$ shows a tendency to drop slightly, the output of controller 28 rises so that selector 32 switches control over to $T_i$, which remains at 160° F. Drying completion can be determined as is known in the art.

Other embodiments of the invention within the following claims will occur to those skilled in the art.

We claim:

1. The method of drying a fibrous material which comprises the steps of circulating air past said material, sensing the wet bulb temperature of air circulating past said material, maintaining the wet bulb temperature of said air constant, sensing the dry bulb temperature of said air before and after circulating past said material, maintaining the dry bulb temperature drop in said air constant, thereby maintaining the evaporation from said material at a constant rate.

2. The method of claim 1 in which said material is lumber.

3. The method of claim 1, wherein said maintaining the dry bulb temperature drop is carried out during a first period and then ended, and further comprising, in a subsequent second period, further drying while controlling inlet dry bulb temperature and still sensing and maintaining said wet bulb temperature.

4. Drying apparatus which comprises a housing, means for introducing drying air into said housing, a support portion for supporting thereon fibrous material for being dried, means for moving said air past said material, means for sensing the wet bulb temperature of said air moving past said material, means for maintaining said wet bulb temperature constant, means for sensing the dry bulb temperature of said air before and after moving past said material, and means for maintaining the dry bulb temperature drop in said air constant, thereby maintaining drying rate at a constant.

5. The apparatus of claim 4 which includes means for reversing the direction of flow of said air and means for shifting the dry bulb sensor sensed to control dry bulb temperature.

6. The apparatus of claim 4 which includes means for controlling the difference in temperature between said inlet dry bulb temperature and said outlet dry bulb temperature.

7. The apparatus of claim 6 which includes means to shift control of inlet air temperature from said difference to said inlet dry bulb temperature.

8. The method of drying a material which will be negatively affected if evaporation therefrom exceeds a safe rate which comprises the steps of circulating air past said material, sensing the wet bulb temperature of air circulating past said material, maintaining the wet bulb temperature of said air constant, sensing the dry bulb temperature of said air before and after circulating past said material, maintaining the dry bulb temperature drop in said air constant, thereby maintaining the evaporation from said material at a constant rate.

9. Drying apparatus which comprises a housing, means for introducing drying air into said housing, a support portion for supporting thereon material which will be negatively affected if evaporation therefrom exceeds a safe rate, means for moving said air past said material, means for sensing the wet bulb temperature of said air moving past said material, means for maintaining said wet bulb temperature constant, means for sensing the dry bulb temperature of said air before and after moving past said material, and means for maintaining the dry bulb temperature drop in said air constant, thereby maintaining drying rate at a constant.

* * * * *